United States Patent [19]

Focke

[11] Patent Number: 4,750,607

[45] Date of Patent: Jun. 14, 1988

[54] APPARATUS FOR CONVEYING CIGARETTE GROUPS

[75] Inventor: Heinz Focke, Verden, Fed. Rep. of Germany

[73] Assignee: Focke & Co. (GmbH & Co.), Verden, Fed. Rep. of Germany

[21] Appl. No.: 889,524

[22] Filed: Jul. 25, 1986

[30] Foreign Application Priority Data

Aug. 2, 1985 [DE] Fed. Rep. of Germany ..... 3527742

[51] Int. Cl.[4] ..... B65B 19/12

[52] U.S. Cl. ..... 198/792; 198/419; 131/283; 53/148

[58] Field of Search ..... 198/792, 419, 420, 796; 131/282, 283; 53/148

[56] References Cited

U.S. PATENT DOCUMENTS

| | | | |
|---|---|---|---|
| 2,932,376 | 4/1960 | Millington | 198/792 |
| 3,126,999 | 3/1964 | Motley | 198/419 |
| 3,448,846 | 6/1969 | Bardenhagen | 198/792 |
| 3,506,105 | 4/1970 | Stauber | 198/792 |
| 3,545,172 | 12/1970 | Osterdahl | 53/236 |
| 4,306,648 | 12/1981 | Manservisi et al. | 198/420 |
| 4,367,618 | 1/1983 | Focke | 53/148 |
| 4,607,477 | 8/1986 | Hinchcliffe | 53/148 |

*Primary Examiner*—Stephen J. Novosad
*Assistant Examiner*—Terry Lee Melius
*Attorney, Agent, or Firm*—Sughrue, Mion, Zinn, Macpeak & Seas

[57] ABSTRACT

For transferring cigarettes or cigarette groups (10) corresponding to a pack from a cigarette magazine (11) to continuously moved blank or folding units (folding turret 20), a pocket conveyor (17) is used as a conveying member. This is driven intermittently, that is to say with a periodic standstill, in one part region (upper strand 23 or lower strand 24) and continuously in another part region (lower strand 24 or upper strand 23).

15 Claims, 9 Drawing Sheets

APPARATUS FOR CONVEYING CIGARETTE GROUPS

BACKGROUND OF THE INVENTION

The invention relates to an apparatus for conveying cigarette groups in or in conjunction with a packaging machine from a receiving station to a delivery station, especially a continuously rotating (folding) turret, by means of a pocket conveyor with pockets, each intended for receiving a cigarette group.

The transport of cigarette groups, each corresponding to the content of a cigarette pack, in conjunction with their packaging presents a special problem. On the one hand, the cigarette groups should be transported at high speed, without being damaged. On the other hand, the conveying member should guarantee exact relative positions for pushing the cigarette groups into pockets of the conveyor and pushing them out of these.

To achieve high performance of a cigarette packaging machine, whilst at the same time ensuring careful treatment of the delicate cigarettes, it is necessary to convey the cigarette groups continuously during the time when they are combined with blanks to form the pack and when folding operations are carried out. On the other hand, because the cigarettes are supplied to the packaging machine in a disorderly fashion and not yet in groups, it is indispensable first to form cigarette groups in succession according to the formation and size of the content of the pack and then introduce them in succession into the flow of movement of the packaging machine. The problem is, therefore, to change from an intermittent supply of cigarette groups (or other articles to be packaged) to a continuous cycle of movement.

SUMMARY OF THE INVENTION

Accordingly, the object on which the invention is based is to design the apparatus mentioned in the introduction, as part of a packaging machine, so that the conveyance of the cigarette groups and consequently the wrapping of these and the folding of the blanks can take place substantially continuously.

To achieve this object, the apparatus according to the invention is characterized by a pocket conveyor with pockets, each intended for receiving a cigarette group which is driven intermittently in the region of one part conveying zone, especially in the region of the receiving station, and continuously in the region of another part conveying zone, especially in the region of the delivery station.

The invention is based initially on the knowledge that a pocket conveyor, as a conveying member for the cigarette groups, is particularly suitable for ensuring the transition from an intermittent cycle of movement to an uninterrupted feedflow. For this purpose, according to the invention, the pocket conveyor is subjected to several superimposed movements. A compensating movement of the pocket conveyor counteracts a continuously rotating drive member, in such a way that the pockets forming the pocket conveyor are stopped temporarily in a part region of the pocket conveyor (upper strand and lower strand). During this short standstill phase, the cigarette groups are introduced into the pocket orifices of the pocket conveyor transversely relative to the conveying direction.

In the region of the delivery station, preferably in the region of a rotating (folding) turret, up against the periphery of which is brought the pocket conveyor, the cigarette groups are transferred to following units, especially to wrapping and folding units, as a result of axis/-parallel displacement of the cigarette groups during continuous transport. This guarantees an extremely high output of the packaging machine, whilst at the same time ensuring very careful treatment of the cigarettes.

According to the invention, the compensating movement superimposed on the drive movement of the pocket conveyor is generated as a result of the to-and-fro movement of deflecting rollers of the pocket conveyor. These rollers are connected to one another at a predetermined distance by a connecting rod which transmits the to-and-fro movement by means of an exactly synchronized drive.

According to a further proposal of the invention, the conveying drive of the pocket conveyor is transmitted to the pocket conveyor by means of the folding turret or a part of the latter (turret disc) rotating at a constant speed. The superimposed compensating movement executed by the deflecting rollers is synchronized with the conveying movement of the pocket conveyor, in such a way that during a to-and-fro movement of the deflecting rollers a standstill phase of an upper strand or lower strand of the pocket conveyor occurs, preferably during a portion of movement of 60° of the to-and-fro movement executed over 360°, the standstill phase occurring approximately in a middle position of the deflecting rollers during the return movement of the latter.

The pocket conveyor, as an endless conveying member for the cigarette groups or other articles, can be designed in various ways. Preferably, however, individual pockets are connected directly to one another via special pocket joints so as to be free of play and free of wear, the pockets being mounted free of play and free of wear on common transversely directed pivot pins by means of rigid connecting plates via rolling bearings.

BRIEF DESCRIPTION OF THE DRAWINGS

Exemplary embodments of the invention are explained in detail below with reference to the drawings. In the drawings.

DETAILED DESCRIPTION OF THE PREFERRED EMBODIMENTS

Figure 1:
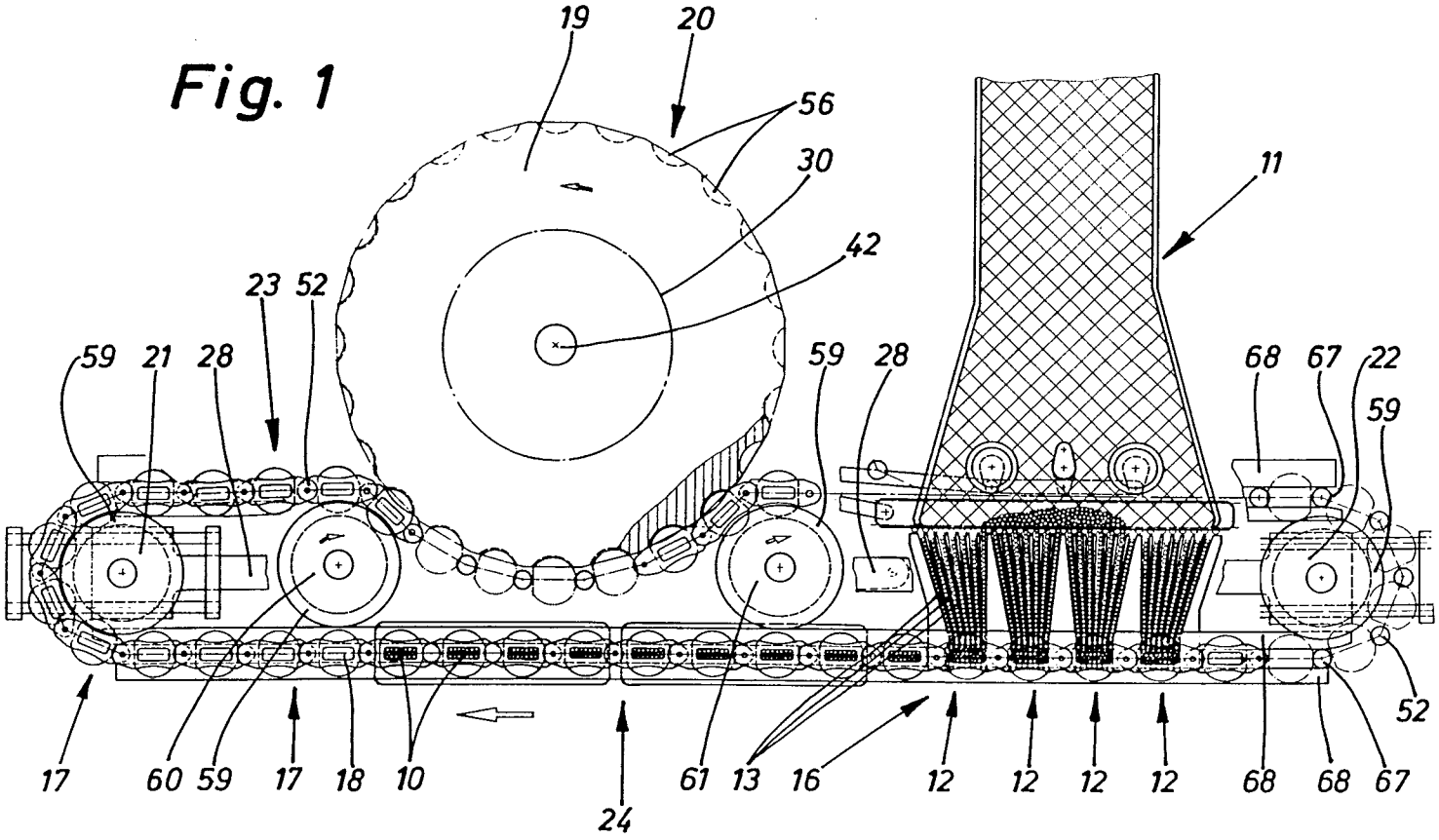
FIG. 1 shows a side view of an apparatus as part of a packaging machine, with a conveyor for cigarette groups.

The exemplary embodiments of an apparatus as part of a packaging machine, which are illustrated in the drawings, are intended for conveying cigarettes formed into cigarette groups 10. These are to be wrapped in blanks to form cigarette packs, especially soft-cup packs.

The cigarettes, coming from a cigarette production machine, are fed to a cigarette magazine 11. This is of conventional design, but with several, in particular four push-out regions for cigarette groups 10. These are shaft groups 12 which are each composed of several shafts 13 brought together. A series of cigarettes arranged above one another is located in each shaft 13 in the usual way. In the lower region, a cigarette group 10 is pushed out of each shaft group 12 by means of slides 14 and supplied to a pocket conveyor 17 via a cigarette channel 15 in the region of a receiving station 16. The pocket conveyor 17 takes up one cigarette group 10 in each pocket 18.

The cigarette groups 10 are supplied by means of the pocket conveyor 17 to wrapping and folding members, of which a turret disc 19 of a folding turret 20 is shown in the drawings. In the region of the folding turret 20, the cigarette groups 10 are ejected from the pockets 18 of the pocket conveyor 17 as a result of axis/parallel displacement and are fed to turret pockets of the folding turret.

The endless pocket conveyor 17 runs over deflecting rollers 21 and 22. In the present case, these are in a common horizontal plane. An upper strand 23 and a lower strand 24 of the pocket conveyor 17 are formed as a result. In the preferred exemplary embodiment of FIG. 1, the receiving station 16 is located in the region of the lower strand 24, so that dust and fine tobacco can fall down freely. The folding turret 20, offset relative to the cigarette magazine 11, is assigned to the upper strand 23. The pocket conveyor 17 is brought up against the periphery of the folding turret 20 or of the turret disc 19 and rests against the periphery of this along a part circle, for example along a quarter circle according to FIG. 1, at a synchronous conveying speed.

Figure 2:
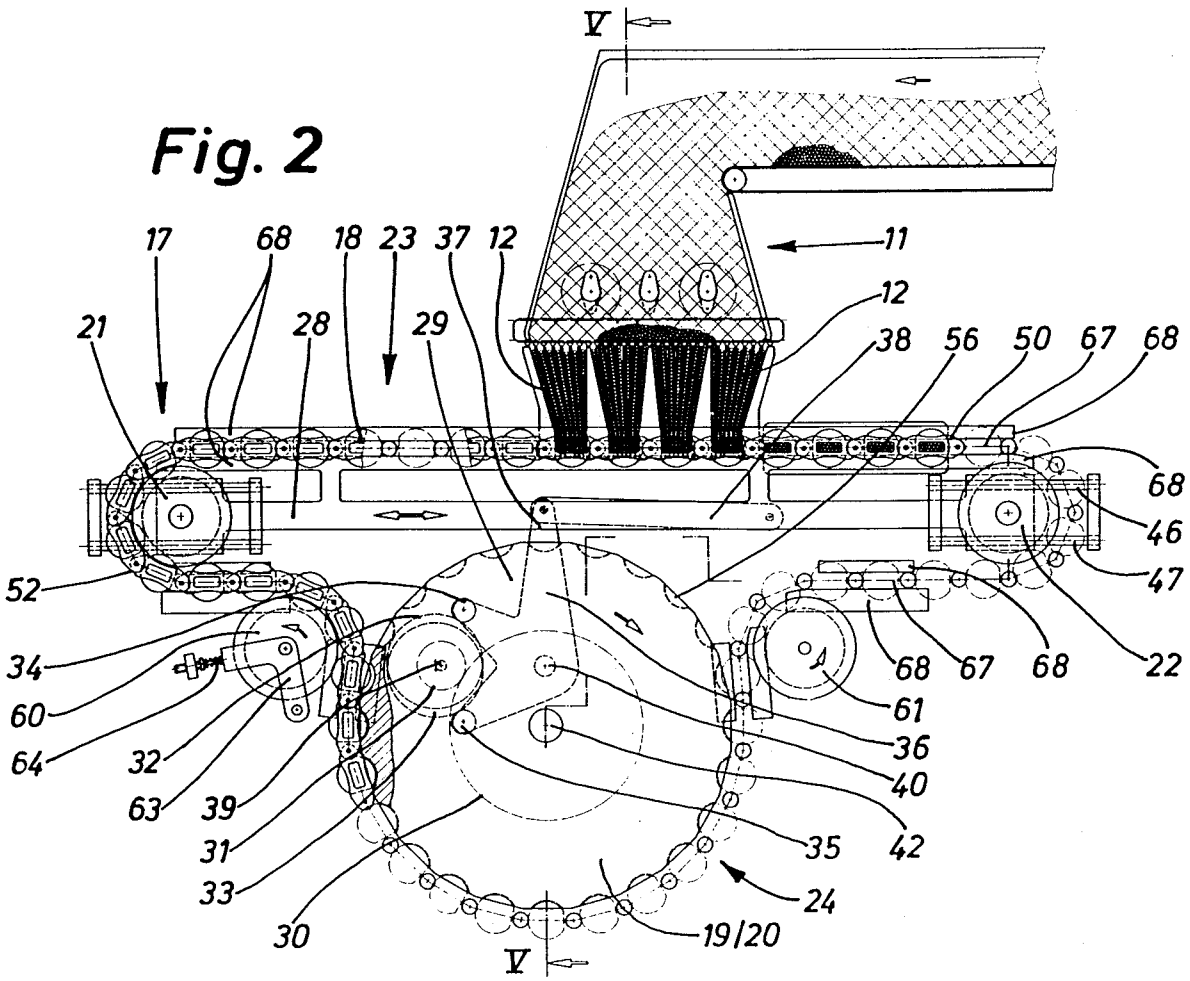
FIG. 2 shows a representation similar to that of FIG. 1, showing another exemplary embodiment of the apparatus.

In the exemplary embodiment of FIG. 2, the cigarette magazine 11 and consequently the receiving station 16 is assigned to the upper strand 23, whilst the folding turret 20 extends in the region of the lower strand 24. Here, the turret disc 19 is surrounded by the pocket conveyor 17 along a larger circular arc, thus forming a longer conveying zone for transfer of the cigarette groups 10.

The movement characteristic of the pocket conveyor 17 is of a special type. In the region of the receiving station 16, that is to say in the region of the lower strand 24 in the exemplary embodiment of FIG. 1 and in the region of the upper strand 23 in the exemplary embodiment of FIG. 2, the pocket conveyor 17 is moved intermittently. For the transfer of the cigarette groups 10, that is to say for pushing these into the pockets 18 adjacent to the shaft groups 12 of the cigarette magazine 11, the pocket conveyor 17 stops momentarily (standstill phase). It is thereby possible for cigarette groups to be pushed in transversely relative to the conveying direction of the pocket conveyor 17. In the region of transfer of the cigarette groups 10 to the folding turret 20 (transfer station), that is to say in the region of the upper strand 23 in the exemplary embodiment of FIG. 1 and in the region of the lower strand 24 in the exemplary embodiment of FIG. 2, the pocket conveyor 17 is moved continuously, specifically with the (constant) peripheral movement of the folding turret 20. As a result of the synchronism, it is possible for the cigarette groups 10 to be transferred to the folding turret 20 during movement.

Figure 9:
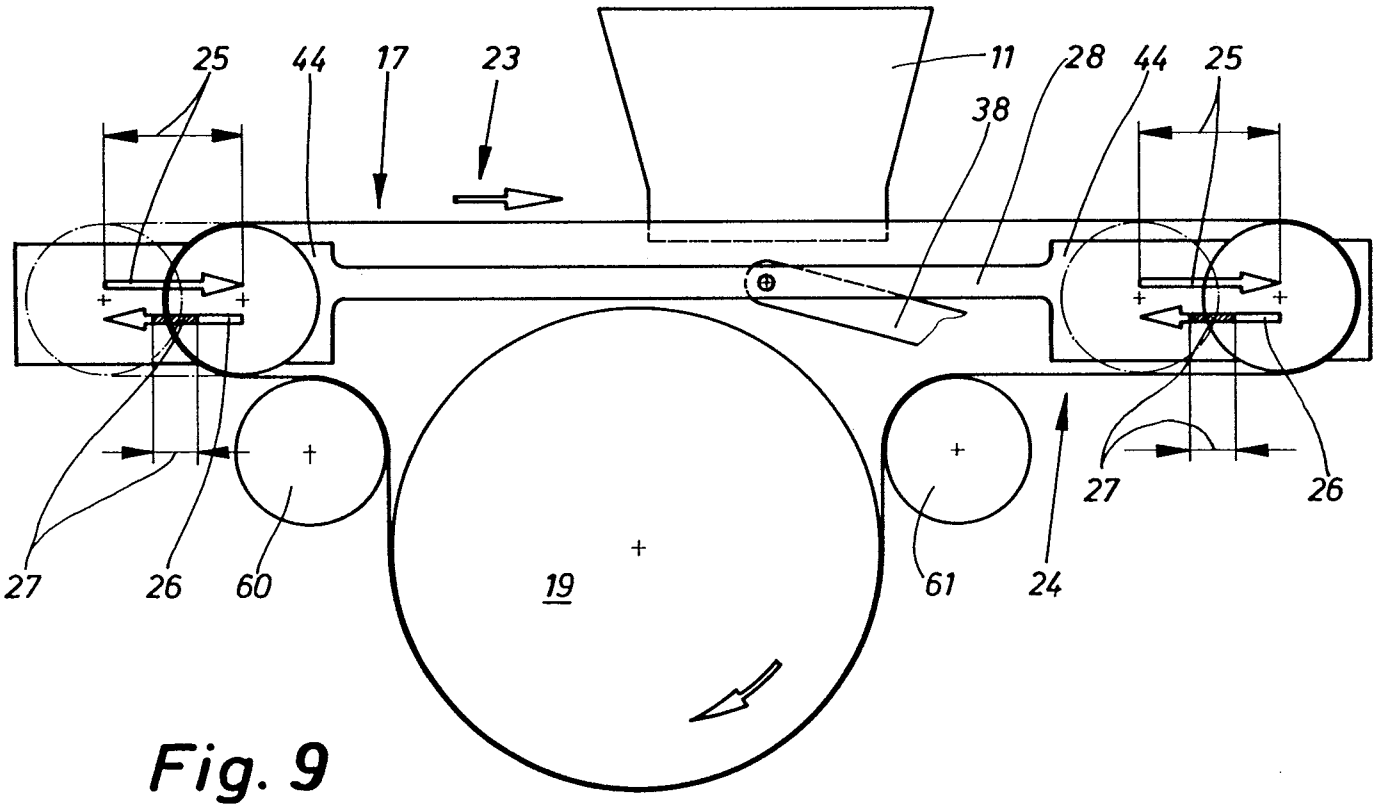
FIG. 9 shows a diagrammatic representation of the cycles of movement of the apparatus in a side view.

This complex movement characteristic of the pocket conveyor 17 is achieved because a compensating movement is superimposed on a constant conveying drive of the latter. This compensating movement is generated by the deflecting rollers 21 and 22 which, in synchronism with the movements in the region of the receiving station 16 and folding turret 20, execute forward movements 25 and return movements 26 of the same amount (FIG. 9). The amount of these movements which, in the present exemplary embodiments, take place in a horizontal plane is coordinated so that during a cycle consisting of a forward movement 25 and return movement 26, there is a (short) standstill phase 27 of the pocket conveyor 17 in the region of the upper strand 23 or lower strand 24. This standstill phase 27 occurs in the middle of the return movement 26, specifically, in the present exemplary embodiment, during a movement phase of 60° in a cycle of movement of 360°.

To generate the compensating movement, the deflecting rollers 21, 22 are arranged at a fixed distance from one another and are connected to one another by means of a connecting rod 28. A to-and-fro drive is exerted on the latter, in the present case by means of a gear 29 which is actuated by the folding turret 20 or turret disc 19.

For this purpose, there is mounted on lhe axle of the folding turret 20 a driving gear wheel 30 which rotates together with the latter and which acts on a small output gear wheel 31. By means of this, two cam discs 32 and 33, arranged offset relative to one another, are in turn made to rotate, tracer and rollers 34, 35 of a pivoting lever 36 run on the two cam discs, respectively. This pivoting lever 36 is itself, via a pivoting arm 37, connected in an articulated manner to a plate 38 and the latter to the connecting rod 28. The cam discs 32 and 33, when of Circular design, are arranged with axes of rotation offset relative to one another and relative to a common axle 39 with the output gear wheel 31. This produces an oscillating pivoting or angular movement of the pivoting arm 37 and consequently a to-and-fro movement of the connecting rod 28 together with the deflecting rollers 21, 22. The pivoting lever 36 is connected via a pivot bearing 40 to part of the machine frame 41. The turret disc 19 is also attached rotatably to the latter via a main bearing 42.

Figure 3:
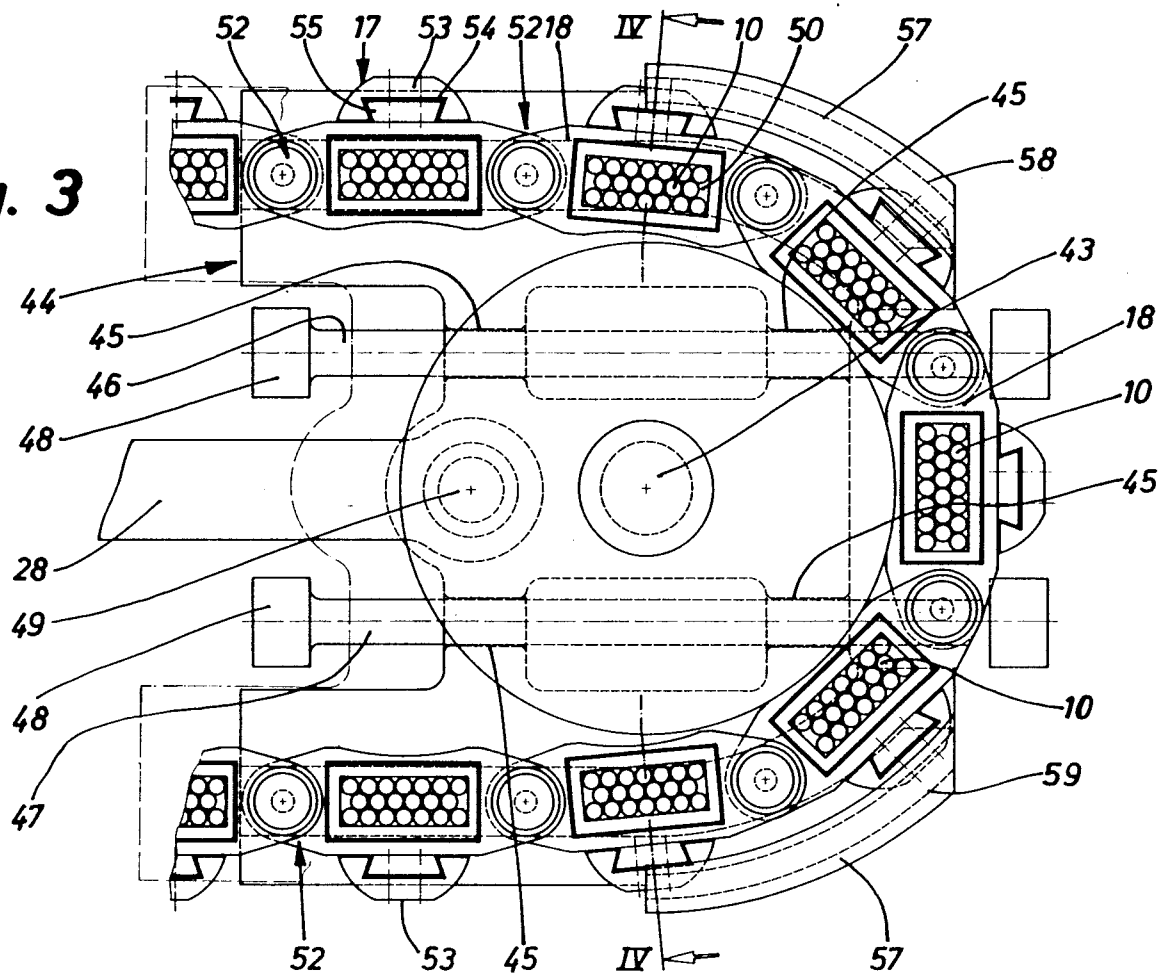
FIG. 3 shows a detail of the apparatus according to FIGS. 1 and 2, with a modified design of the conveyor, in a side view on an enlarged scale.
Figure 4:
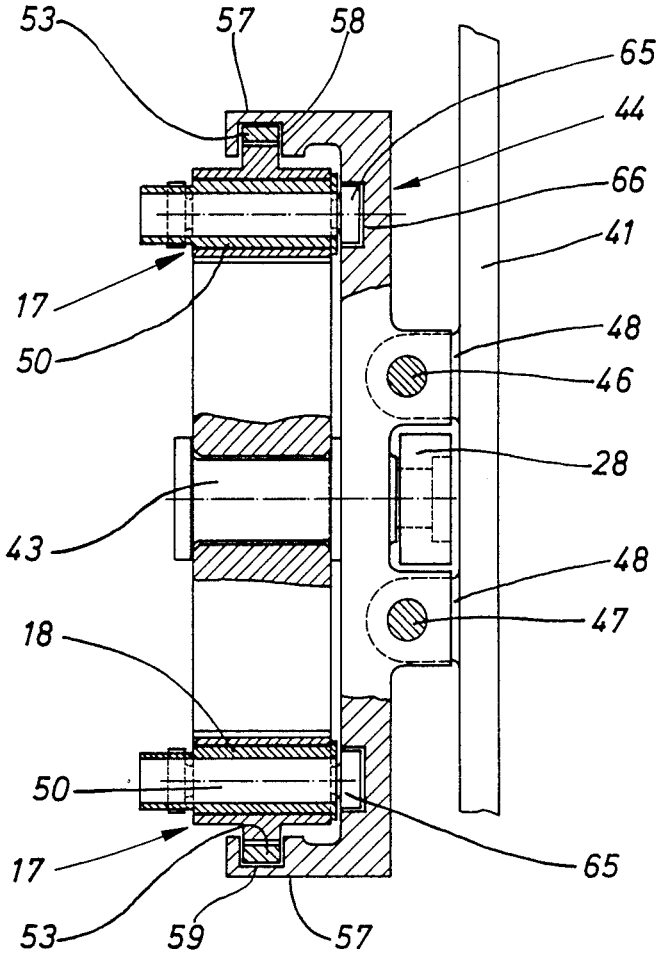
FIG. 4 shows a section IV—IV of FIG. 3.

In order to execute the to-and-fro movements 25, 26, the deflecting rollers 21, 22 are mounted in a special way. As can be seen particularly in FIGS. 3 and 4, each deflecting roller 21, 22 is rotatably attached laterally to a supporting member, in particular a supporting disc 44, via a bearing journal 43. The supporting disc 44 movable to-and-fro together with the deflecting roller 21, 22 is itself supported via plain bearings 45 on two guide rods 46, 47 located above one another and extending in horizontal planes. These in turn are connected firmly to the machine frame 41 or a supporting wall via retaining pieces 48. The connecting rod 28 is connected via a pin joint 49 to the supporting disc 44, so that the latter is driven to-and-fro directly, at the same time taking up the deflecting roller 21, 22. The pin joint 49 is attached to the supporting disc 44 at a distance from the bearing journal 43.

The pocket conveyor 17 can be designed in various ways. A particularly advantageous design according to FIGS. 3 and 4 consists of individual rigid links, in particular the pockets 18, made of metal or the like. Each pocket is provided with a pocket orifice 50 for receiving a cigarette group 10, with the cigarettes arranged transversely. The pockets 18 are connected pivotably to one another by means of pocket joints 52, specifically free of elongation and free of wear as a result of the incorporation of ball bearings. This makes it possible to obtain exact conveyance of the cigarette groups 10 by means of the pocket conveyor 17. The pocket orifices 50 lie in the longitudinal mid-plane of the pocket conveyor 17 or symmetrically relative to this.

In the present exemplary embodiment, toothed webs 53 are attached to the outside of the pockets 18 approximately in the vertical longitudinal mid-plane. These can be formed from the material of the pocket 18 or, as here, consist of plastic and be connected to a pedestal 55 of the pocket 18 by means of a dovetailed joint 54.

Figure 5:
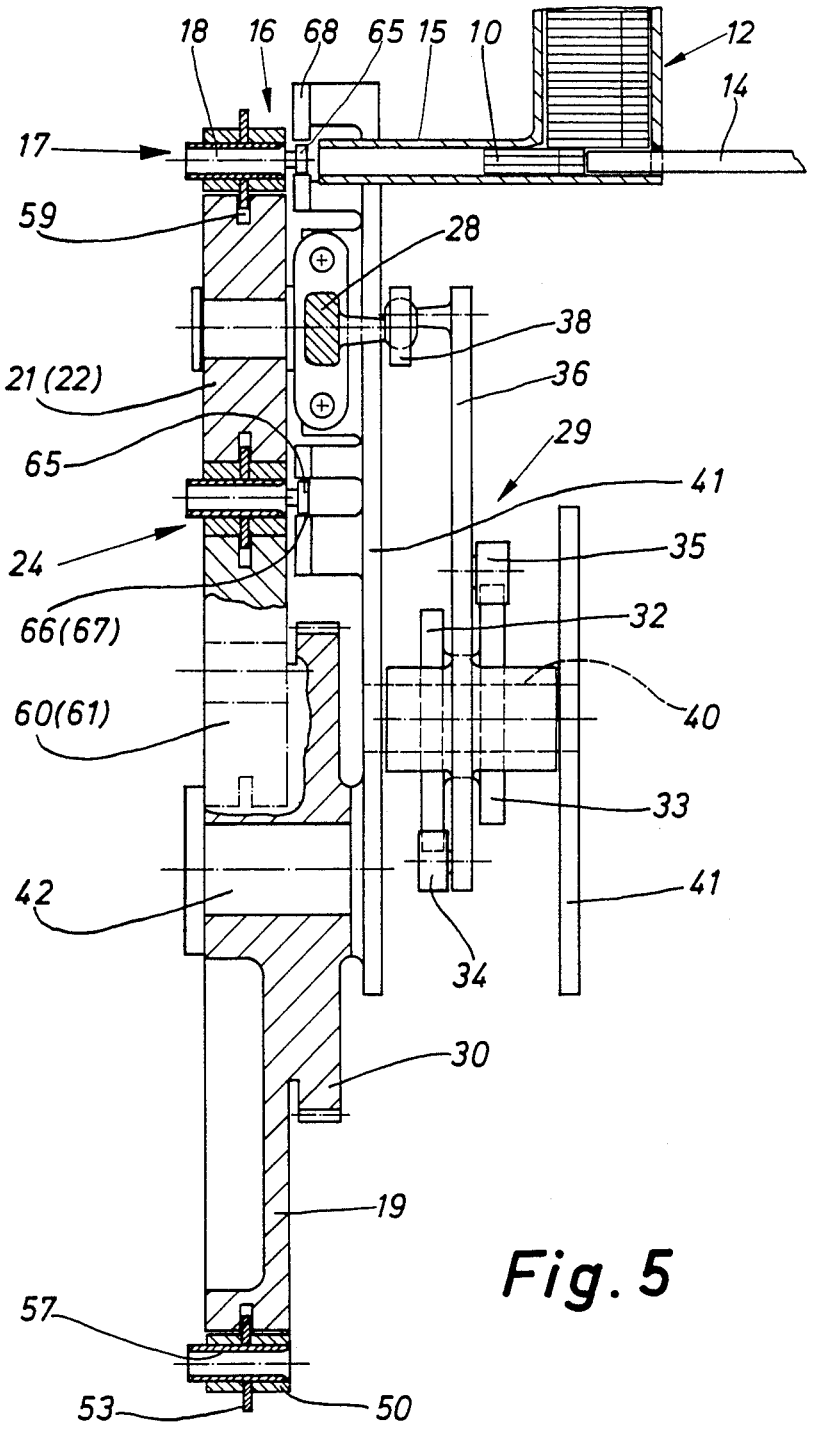
FIG. 5 shows a vertical section V—V of FIG. 2.
Figure 6:
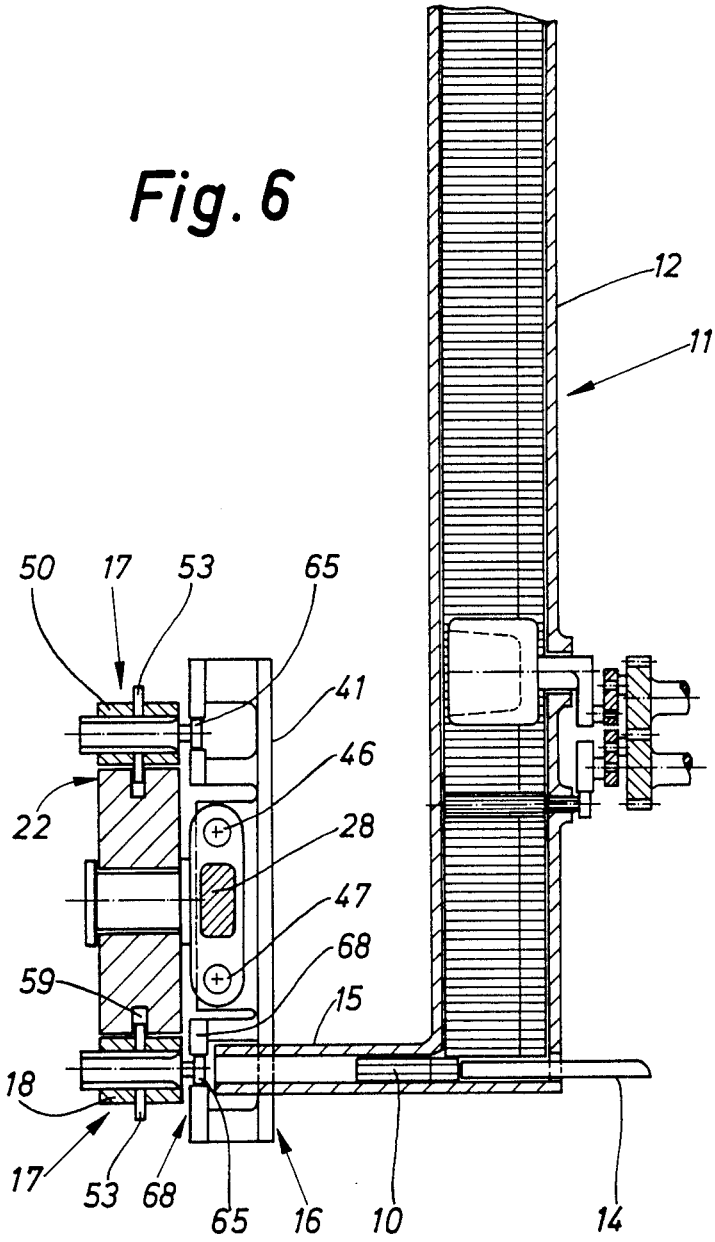
FIG. 6 shows an offset vertical section in the region of a receiving station of the apparatus.
Figure 7:
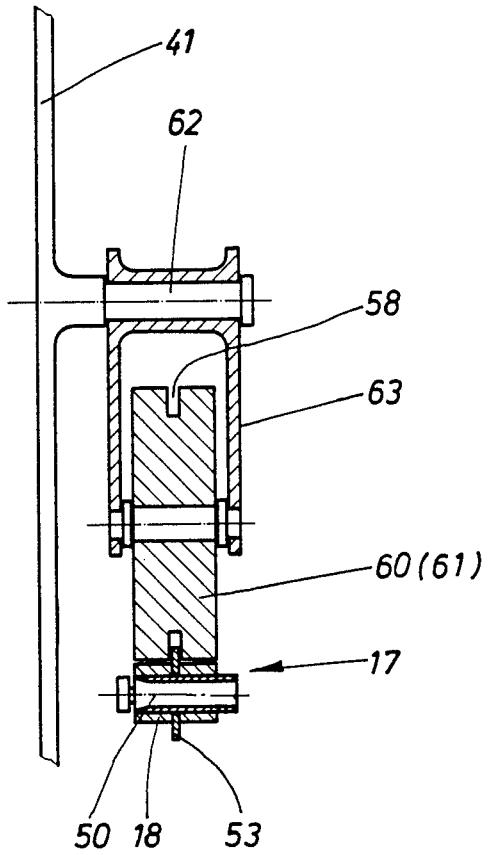
FIG. 7 shows a radial section through a detail of the apparatus, in particular a pressure roller.

The toothed webs 53 have a multiple function. In the region of the folding turret 20 or turret disc 19, the toothed webs 53 penetrate positively into correspondingly shaped depressions 56 along the periphery of the turret disc 20. This ensures meshing between the pocket conveyor 17 and turret disc 19 in the region where the former comes up against the latter, so that not only is there an exact relative position, but the (continuous) drive can be transmitted to the pocket conveyor 17 by the turret disc 19. As is evident in FIG. 5, the depressions 56 can be made slot-shaped.

Furthermore, in several regions of the path of rotation of the pocket conveyors 17, the toothed webs 53 ensure lateral guidance of the latter. The supporting disc 44 is equipped, in the region of deflection, with guide rails 57 formed on the outside of the supporting disc 44, with a U-shaped cross-section, into which the toothed webs 53 penetrate positively and in a sliding manner in the region of deflection.

A modified design of the pocket conveyor 17 is shown in FIGS. 1 and 2 and 5, 6 and 7. In this design, the pockets 18 designed in a similar way to that described above are divided in the longitudinal mid-plane and therefore consist of two part pockets. Inserted in the dividing plane is a toothed web 53 which is designed as a circular disc and which extends above and below the pocket 18. Positive engagement with guide or drive members on both sides of the pocket conveyor 17 is thereby possible. In the exemplary embodiment of FIG. 1, the toothed web 53 penetrates by means of the upper region into the depressions 56 of the turret disc 19, whilst in the design according to FIG. 2 the inner regions of the toothed webs 53 bring about the positive engagement.

As a result of this design of the pockets 18 or toothed webs 53, it is also possible to obtain guidance in the region of the deflecting rollers 21, 22 by means of the toothed webs 53. These penetrate into an annular central guide slot 58 of the deflecting rollers 21, 22, thus ensuring additional lateral guidance.

Of similar design, in particular with a guide slot 59, are pressure rollers 60, 61 which are arranged in the region of run-on of the pocket conveyor 17 onto the periphery of the turret disc 19 and in the region of run-off from the latter and which press the pocket conveyor 17 spring-elastically against the periphery of the turret disc 19. As is evident in FIG. 7, the pressure rollers are mounted on a supporting journal 62 which is itself attached to part of the machine frame 41. A pivotable supporting arm 63 of the pressure roller 60, 61 is loaded in a pressing-on direction by a compression spring 64.

Here, the pocket conveyor 17 is also provided with a guide against undesirable vertical movements, specifically with supporting rollers 65 arranged on one side or on both sides. These supporting rollers 65 resting on the axle (axle pin) of the pocket joint 52 penetrate into guide grooves 66, 67 next to the path of movement of the pocket conveyor 17. Guide grooves 66 of this type are formed in the lateral supporting disc in the region of the deflecting rollers 21, 22. This safeguards the deflection region in particular. Furthermore, a straight guide groove 67 is formed between fixed guide rails 68 of the straight strand of the pocket conveyor 17, particularly in the region of the lower strand 24 in the exemplary embodiment of FIG. 1 and in the region of the upper strand 23 in the exemplary embodiment of FIG. 2. Further guide groove 67 with guide rails 68 are arranged adjacent to the turret disc 19.

Figure 8:
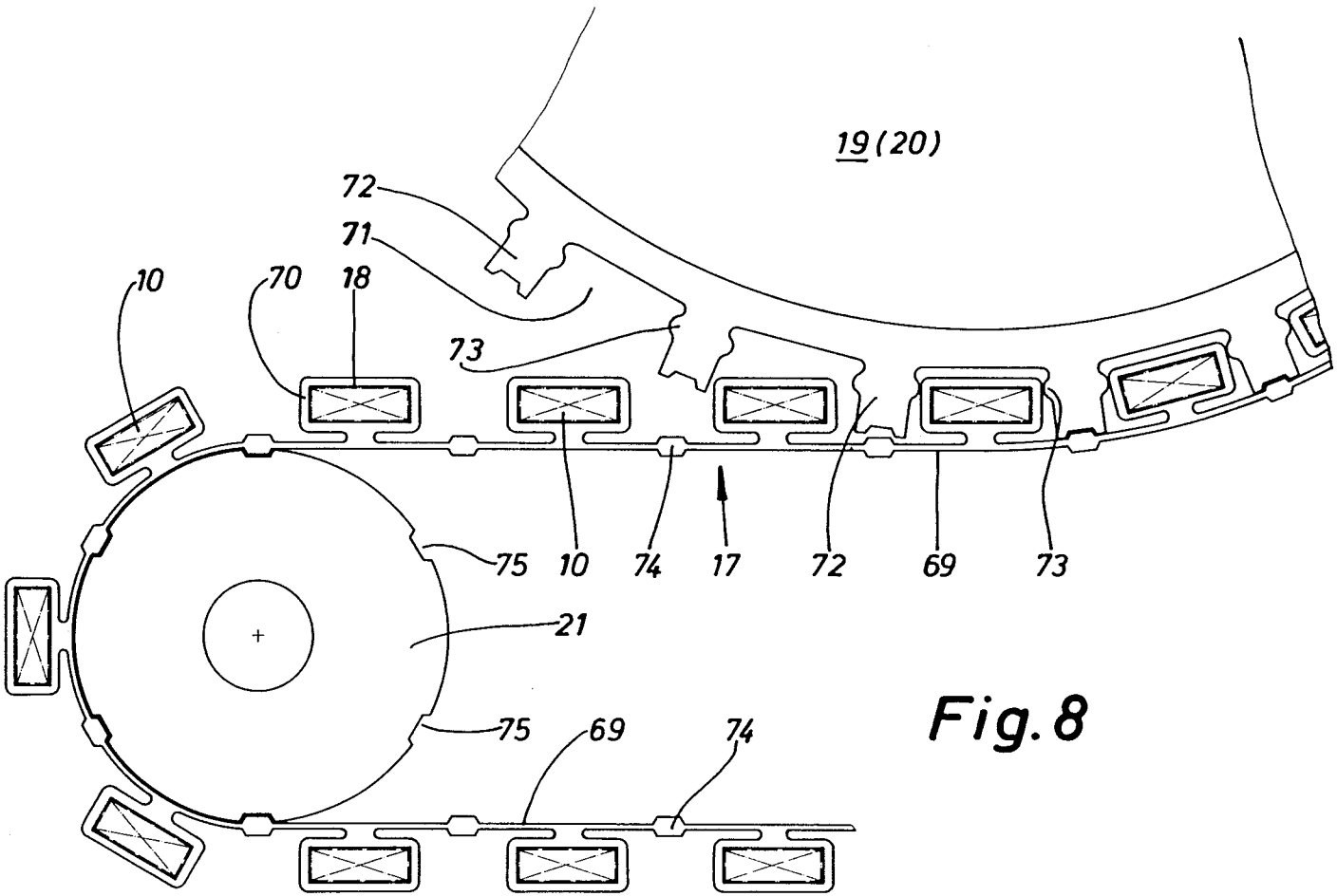
FIG. 8 shows a side view of a further exemplary embodiment of the design of the conveyor.

FIG. 8 illustrates a further possible alternative design of the pocket conveyor 17. Here, a carrier strip 69 made of elastic material (plastic, rubber), with embedded inserts of high tensile strength, is provided on one side with attached pocket members 70 having pockets 18. The pocket members 70 designed as hollow bodies and open on the sides are formed on the carrier strip 69 integrally with the latter.

In the present case, the pocket members 70 form elements (teeth) for positive engagement with the periphery of the turret disc 19. Here, this is designed with toothed depressions 71, into which the pocket members 70 penetrate the positively during the time when they come up against the periphery of the turret disc 19. Adjacent toothed depressions 71 are limited by intermediate webs 72 which, for fixing and positioning the pocket members 70 in the toothed depressions 71, have centering beads 73 projecting into the latter. This design makes it possible for the pocket member 70 to penetrate into and escape from the toothed depressions 71 free of constraint.

For further guidance of this pocket conveyor 17, thickened profile portions 74 of approximately trapezoidal cross-section are formed on between the pocket members 70. These thickened profile portions 74 penetrate into correspondingly shaped toothed recesses 75, corresponding approximately to half the cross-section of the thickened profile portion 74, of the deflecting rollers 21, 22, on the one hand, and into the radially outer end faces of the intermediate webs 72 of the turret disc, on the other hand. The cycles of movement of this pocket conveyor 17 according to FIG. 8 correspond to those described.

I claim:

1. Apparatus, including a continuously rotating folding turret (20), for conveying cigarette groups (10) from a receiving station (16) to a delivery station in a cigarette-packaging machine, characterized by: an endless pocket conveyor (17) which has pockets (50) for receiving one cigarette group (10) each, which is intermittently driven in the region of the receiving station (16), and which is continuously driven in the region of the turret (20); the folding turret (20) being meshed with the pocket conveyor (17) in the region of the delivery station so that the conveyor (17) is driven by the continuously rotating folding turret (20) in synchronism therewith; and the folding turret (20) having turret pouches along its periphery for receiving the cigarette groups (10) through axis-parallel shifting of the cigarette groups during the synchronism between the folding turret (20) and the pocket conveyor (17).

2. Apparatus according to claim 1, characterized in that a superimposed compensating drive, which compensates differences in movement between the continuous drive and the intermittent drive, is transmitted to the pocket conveyor (17).

3. Apparatus according to claim 2, characterized in that the pocket conveyor (17) is endless and is guided via deflecting rollers (21, 22), at least one of which executes to-and-fro compensating movements.

4. Apparatus according to claim 3, characterized in that the two deflecting rollers (21, 22) execute simultaneous compensating movements in the same direction.

5. Apparatus according to claim 4, characterized in that the deflecting rollers (21, 22) are arranged at an invariable distance from one another via a connecting rod (28) to which a to-and-fro drive can be transmitted (forward movement 25, return movement 26).

6. Apparatus according to claim 4, characterized in that the deflecting rollers (21, 22) are mounted on roller guides (guide rods 46, 47) so as to be displaceable in a common horizontal plane.

7. Apparatus aCcording to claim 6, characterized in that the deflecting rollers (21, 22) are mounted rotatably on a supporting disc (44) which itself is retained displaceably on horizontal guide rods (46, 47).

8. Apparatus according to claim 5, characterized in that the connecting rod (28) is driven by the turret (20) in order to execute the compensating movements of the deflecting rollers (21, 22).

9. Apparatus according to claim 3, characterized in that one of an upper strand (23) and a lower strand (24) of the pocket conveyor (17) is assigned to the turret (20) and is moved at a constant speed, and the other strand is assigned to the receiving station (16), including a cigarette magazine (11), and is moved intermittently to have a standstill phase (27).

10. Apparatus according to claim 9, characterized in that the one intermittently moving strand of the pocket conveyor (17) experiences the standstill phase (27) during a forward movement (25) and a return movement (26)—movement cycle—of the deflecting rollers (21, 22).

11. Apparatus according to claim 10, characterized in that the standstill phase (27) is produced during a fraction of the forward movement (25) or return movement (26) of the deflecting rollers (21, 22), during a middle portion of movement amounting to approximately 60° of the return movement (26).

12. Apparatus according to claim 1, characterized in that the pocket conveyor (17) is meshed with the periphery of the folding turret (20) via toothed webs (53) of pockets (18) which penetrate positively into toothed depressions (56) of the folding turret (20).

13. Apparatus according to claim 1, characterized by means for guiding the pocket conveyor (17), at least in part regions, against lateral and up-and-down movements.

14. Apparatus for conveying cigarette groups or other articles in or in conjunction with a packaging machine from a receiving station to a delivery station having a continuously rotating folding turret, characterized by a pocket conveyor (17) which has pockets (50), each intended for receiving one cigarette group (10), which is driven intermittently in the region of a first part conveying zone in the region of the receiving station (16) and which is continuously driven in the region of another part conveying zone in the region of the delivery station (20);

further characterized in that:

the pocket conveyor (17) is endless and is guided via two deflecting rollers (21, 22) which execute simultaneous to-and-fro compensating movements in the same direction;

the deflecting rollers (21, 22) are arranged at an invariable distance from one another via a connecting rod (28) to which a to-and-fro drive is transmitted (forward movement 25, return movement 26);

the connecting rod (28) is driven by the folding turret (20) in order to execute the compensating movements of the deflecting rollers (21, 22); and in that an equiaxial gear wheel (driving gear wheel 30), rotating together with the folding turret (20), drives two cam discs (32, 33) on which supporting arms, of a two-armed pivoting lever (36) for driving the connecting rod (28), run by means of tracer rollers (34, 35).

15. Apparatus according to claim 14 further characterized in that a superimposed compensating drive, which compensates differences in movement between the continuous drive and the intermittent drive, is transmitted to the pocket conveyor (17).

* * * * *